United States Patent [19]

Ellenbaum et al.

[11] Patent Number: 4,963,185

[45] Date of Patent: Oct. 16, 1990

[54] AGGLOMERATES CONTAINING OLIVINE FOR USE IN BLAST FURNACE

[75] Inventors: Frank H. Ellenbaum, Willowbrook, Ill.; Richard Ciesco, Griffith, Ind.

[73] Assignee: Applied Industrial Materials Corporation, Mundelein, Ill.

[21] Appl. No.: 735,349

[22] Filed: May 17, 1985

Related U.S. Application Data

[60] Division of Ser. No. 329,777, Dec. 11, 1981, abandoned, which is a division of Ser. No. 90,538, Nov. 2, 1979, abandoned, which is a division of Ser. No. 652,549, Jan. 26, 1976, abandoned, which is a continuation-in-part of Ser. No. 493,696, Aug. 1, 1974, Pat. No. 3,966,456.

[51] Int. Cl.[5] ..... C21B 3/02

[52] U.S. Cl. ..... 75/323; 75/472

[58] Field of Search ..... 75/257

[56] References Cited

U.S. PATENT DOCUMENTS

| | | | |
|---|---|---|---|
| 2,837,419 | 6/1958 | Sellers et al. | 75/41 |
| 3,264,091 | 8/1966 | Ban | 75/3 |
| 3,396,010 | 8/1968 | Gould | 75/30 |
| 4,518,428 | 5/1985 | Ellenbaum et al. | 75/257 |

OTHER PUBLICATIONS

McGannon, *Making, Shaping & Treating Steel,* 1964, U.S.S., pp. 429–430.

*Primary Examiner*—Melvyn J. Andrews

*Attorney, Agent, or Firm*—Banner, Birch, McKie & Beckett

[57] ABSTRACT

A process for the reduction of iron oxides to produce molten iron in which olivine is introduced into a blast furnace in addition to iron oxide bearing materials and in which there is a high content of alkali metal oxides in the materials charged into the furnace, resulting in minimizing or preventing "scaffolding" and improving the operation of the furnace. The disclosure further includes improvements in which olivine is mixed with iron bearing materials or with coke and such mixture is formed into agglomerates having improved properties and in which such agglomerates are charged into the furnace.

6 Claims, No Drawings

AGGLOMERATES CONTAINING OLIVINE FOR USE IN BLAST FURNACE

This application is a division of copending Ser. No. 329,777 filed Dec. 11, 1981; which was a division of Ser. No. 090,538 filed Nov. 2, 1979, now abandoned, which was a division of Ser. No. 652,549 filed Jan. 26, 1976, now abandoned, which was a continuation-in-part of our prior application Ser. No. 493,696 filed Aug. 1, 1974 now U.S. Pat. No. 3,966,456.

This invention relates to a process for producing molten iron in a blast furnace in which olivine is charged into a blast furnace in addition to iron ore or other iron oxide bearing materials. The invention relates particularly to such a process in which agglomerates containing mixtures of olivine with iron bearing materials or mixtures of olivine with coke are charged into the furnace, and further relates to agglomerates containing such mixtures and to processes for the preparation of such agglomerates.

BACKGROUND

The operation of the blast furnace in the production of iron involves processes of chemical reduction in which oxides of iron and other metals are reduced and oxygen removed. The blast furnace is charged with four basic ingredients: (1) iron oxides, in the form of raw ore, beneficiated pellets, briquettes, nodules, sinters, or other agglomerates; (2) calcium carbonate (the term calcium carbonate is used to include either limestone or dolomite); (3) a fuel usually in the form of coke; and (4) air which provides oxygen to support the combustion. The raw iron as it comes from the Lake Superior region has contained approximately 50 percent iron in the form of iron oxide ($Fe_2O_3$), with the remainder being silica ($SiO_2$), aluminum ($Al_2O_3$), magnesia (MgO), lime (CaO), sulfur (S) and phosphorous (P), and manganese oxide (MnO). The sulfur and phosphorous are commonly considered impurities.

The iron oxides, or other metallic charged materials, coke and calcium carbonate are charged into the blast furnace, one at a time, in measured amounts, to form layers of iron ore, limestone or dolomite, and coke; and air (wind) is passed through these layers and the coke is burned. Burning of the coke produces heat and carbon monoxide which has a part in the chemical reduction of the iron oxides. As the coke burns the iron oxides are reduced and come into the form of molten iron. The limestone or dolomite, along with quantities of impurities such as sulfur and phosphorous form a slag. The hearth which is located in the lower part of the furnace, is the hottest part of the furnace and the layers of ore, coke and calcium carbonate keep moving downwardly within the furnace to the hearth.

At some point in this movement downwardly in the furnace slag is formed, and after its full passage downwardly in the furnace it is withdrawn from the furnace in the form of liquid slag. The slag is important to the operation of the furnace because it carries with it many unwanted impurities and so separates these from the iron and removes them from the furnace.

When the downward movement of the iron bearing charged materials, the coke and the calcium carbonate proceeds in a uniform way with the movement taking place constantly and evenly on all sides of the furnace, this is evidence of good operation. Unfortunately, this is not always the case.

As is well known to blast furnace operators there are times when the downward movement of the ingredients charged into the furnace is not regular and uniform or when the movement at some place within the furnace is greater than at other places, making the furnace unbalanced. There are even times when at substantial areas the movement becomes restricted, and then after operation for a time under such conditions the whole mass may let loose, descending at once into the hot part of the furnace with the result that the hearth temperature is reduced below an operable temperature, sometimes almost extinguishing the fire. When this happens, the furnace may have to be shut down, cleaned and restarted, which is a time-consuming and expensive operation.

It is our belief that the faulty operation above referred to is due in large part to the presence in the charged materials of alkali metal oxides such as $Na_2O$, $K_2O$ and $Li_2O$. These oxides appear to pass downwardly to hotter parts of the furnace and there become volatilized after which they pass upwardly in the furnace with the wind and then condense above the mantle of the furnace forming stable alkali-alumino silicates. Such silicates are believed to lead to a scaffolding effect which prevents the layered burning material from descending in a regular, uniform manner. A continuation of this action develops a situation where the mass will collapse of its own weight, chilling the furnace hearth where the most important smelting reactions take place.

DESCRIPTION

In our co-pending application Ser. No. 493,696 we set forth the improvement in blast furnace operation where the charged materials contain in excess of about 1 pound of alkali metal oxides per net ton of molten iron produced by charging into the furnace a special mineral called olivine, to improve the furnace operation, removing a substantial part of the alkali metal oxides in the slag and preventing the occurrence of falling burden as above described.

The olivine above referred to is a special mineral in the form of an ore which may be crushed and sized and which has the following analysis:

| | |
|---|---|
| MgO | 40 to 50 weight percent |
| $SiO_2$ | 35 to 45 weight percent |
| $Fe_2O_3$ | 6.5 to 10 weight percent |

The term "olivine" as used in this specification and claims is in the form of an ore which contains MgO, $SiO_2$ and $Fe_2O_3$ in the proportions above stated and which contains forsterite in an amount of 80 percent or more, usually about 88 to 90 percent and contains iron silicate ($2FeO.SiO_2$) in an amount of from 3 to 12 weight percent, usually about 8 to 9 percent, and which is substantially free of alkali metal compounds, less than 0.5 weight percent and contains more than 90 percent nesosilicates, these percentages being based on the total weight of the olivine.

The olivine may be charged into the furnace along with the iron oxide bearing materials and in the amount of from about 0.10 to 10.0 weight percent of the iron bearing charged materials, preferably in an amount of from 0.25 to 5.0 weight percent of the iron oxide bearing charged materials. Charged materials having higher alkali metal oxide content (in excess of 1 pound per net ton of molten metal produce) may be treated to produce molten metal in a blast furnace with much less difficulty when the olivine is also included.

We do not know with certainty the exact reason for such improvement, but a possible theory explaining the improved results is that the olivine provides a source of useful oxides (MgO, FeO and $SiO_2$) without the evolution of carbon dioxide which is associated with dolomite, for example, and results in raising the point in the geometry of the furnace at which the slag becomes fused, or in other words, causes the slag to be formed higher in the furnace which means that the slag is formed earlier in the total reduction process. This allows more time for the slag reactions to take place and for the impurities to be converted to stable compounds, thus making the process more effective for the removal of sulfur and alkali metal compounds. Also, the tendency for previously fused slag to resolidify is reduced. Further, we believe the earlier slag formation resulting from the introduction of olivine causes the slag to react with more iron oxide surfaces and more $Fe_2O_3$ to be reduced FeO. Also, the olivine itself contains up to 10 percent $Fe_2O_3$ which also is reduced in the course of reduction processes.

The olivine has a tough durable grain with a hardness of about 6.5 to 7.0 on the Mohs Scale and is mechanically strong as compared to limestone or dolomite, and has an advantage in burden permeability and gas-solid contact. Another benefit from the introduction of olivine is in the area of iron chemistry control. Less dust loss and increased carbon monoxide evolution means that control of silicon and manganese reduction are more precise. Heat losses due to calcination are lessened and slag mineralogy improved along with the better control obtained in this improved operation. The earlier formation of liquid slag further permits a more acid slag composition thus lowering the requirement for basic oxides such as limestone or dolomite.

To demonstrate more specifically how to practice the improved process in which olivine and charge materials having a high alkali metal oxide content are introduced to a blast furnace, we set forth tests which may serve as specific illustrations of how the invention may be practiced and the results which are to be expected.

The following Table I describes a program to be followed over a 30-day period in which the amounts of the materials for one complete charge are listed in the left-hand column. It should be understood that the same amounts and relative proportions of charge materials are continued during the day listed in the table until the time a different amount of the various charges is prescribed and carried out. The test is begun by accumulating data during a base period. After this the change in the charge is made and continued long enough to provide an evaluation of the operation.

TABLE I

| | |
|---|---|
| Base period - quantities of charge ingredients for one charge | |
| Pellets | 29,550 lbs. |
| Mn-bearing ore | 450 lbs. |
| Scrap | 2,000 lbs. |
| Coke | 14,000 lbs. |
| Dolomite | 3,000 lbs. |
| Limestone | 2,000 lbs. |
| First day of olivine test - quantities/charge | |
| Pellets | (same as in base period) |
| Mn-bearing ore | (same as in base period) |
| Scrap | (same as in base period) |
| Coke | (same as in base period) |
| Olivine | 125 lbs. of size $-2 + \frac{1}{2}$ |
| Dolomite | 2,650 lbs. |

TABLE I-continued

| | |
|---|---|
| Limestone | 2,250 lbs. |
| Third day of olivine test - quantities/charge | |
| Pellets | (same as in base period) |
| Mn-bearing ore | (same as in base period) |
| Scrap | (same as in base period) |
| Coke | (same as in base period) |
| Olivine | 250 lbs. |
| Dolomite | 2,300 lbs. |
| Calcite Stone | 2,500 lbs. |
| Fifth day of olivine test - quantities/charge | |
| Pellets | (same as in base period) |
| Mn-bearing ore | (same as in base period) |
| Scrap | (same as in base period) |
| Coke | (same as in base period) |
| Olivine | 375 lbs. |
| Dolomite | 1,950 lbs. |
| Limestone | 2,750 lbs. |
| Seventh day of olivine test - quantities/charge | |
| Pellets | (same as in base period) |
| Mn bearing ore | (same as in base period) |
| Scrap | (same as in base period) |
| Coke | (same as in base period) |
| Olivine | 500 lbs. |
| Dolomite | 1,600 lbs. |
| Limestone | 3,100 lbs. |
| Seventeenth day of test - quantities/charge | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 1,200 lbs. |
| Limestone | 3,400 lbs. |
| Eighteenth day of test - quantities/charge | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 800 lbs. |
| Limestone | 3,800 lbs. |
| Nineteenth day of test - quantities/charge | |
| Pellets | (same as in base period) |
| Mn-bearing ore | (same as in base period) |
| Scrap | (same as in base period) |
| Coke | (same as in base period) |
| Olivine | 600 lbs. |
| Dolomite | 400 lbs. |
| Limestone | 4,200 lbs. |
| Twentieth day of test - quantities/charge | |
| Pellets | (same as in base period) |
| Mn-bearing ore | (same as in base period) |
| Scrap | (same as in base period) |
| Coke | (same as in base period) |
| Olivine | 600 lbs. |
| Limestone | 4,200 lbs. |
| Twenty-fifth day of test - quantities/charge | |
| Pellets | (same as in base period) |
| Mn-bearing ore | (same as in base period) |
| Scrap | (same as in base period) |
| Coke | (same as in base period) |
| Olivine | 600 lbs. |
| Limestone | 4,600 lbs. |
| Thirtieth day of test - quantities/charge | |
| Test terminated. | |

The purpose of the test set forth in Table I is to demonstrate the effect of the olivine on the operation of the blast furnace. As shown in this Table the olivine is increased during the first seven days of the test. The volume of slag may be expected to increase during the test but the basicity and V-ratio will decline. The $Na_2O$ and $K_2O$ content of the slag may be expected to increase. Since the $Al_2O_3$ content of the slag should be substantially constant the increase in the NaO and $K_2O$ content of the slag may be established by plotting the $Na_2O$-/$Al_2O$ and the $K_2O/Al_2O_3$ ratios. Also the ratio of CO to $CO_2$ may be determined and plotted to measure furnace efficiency, and if it is determined that more $Fe_2O_3$ is being reduced to FeO during the reference period, this is an indication that the olivine is promoting early slag formation, and an improvement in the coke rate will result. Further, if the furnace starts to peel early in the test, this is an indication the olivine is having a favorable effect.

TABLE II

CHARGE CALCULATIONS IN TEST OF BLAST FURNACE OPERATION

| CHARGE-LBS./CHARGE | | SLAG AIM CHEMISTRY CaO | MgO | $SiO_2$ | $Al_2O_3$ | Base/Acid Ratio | SLAG VOLUME LBS./TON of IRON | LENGTH OF PERIOD |
|---|---|---|---|---|---|---|---|---|
| BASE PERIOD-LBS./CHARGE | | | | | | | | |
| Erie | 69,500 | | | | | | | |
| Sinter | 13,900 | | | | | | | |
| BOFS | 6,500 | 42 | 12 | 35 | 8.9 | 1.23 | 665 | Indefinitely |
| Dolomite | 6,800 | | | | | | | |
| Coke | 28,000 | | | | | | | |
| 1st TEST PERIOD-LBS./CHARGE | | | | | | | | |
| Erie | 70,000 | | | | | | | |
| Sinter | 15,000 | | | | | | | |
| BOFS | 5,000 | 38.6 | 13.5 | 36.5 | 9.1 | 1.14 | 640 | 10 days |
| Dolomite | 6,000 | | | | | | | |
| Olivine | 1,000 | | | | | | | |
| Coke | 28,000 | | | | | | | |
| 2nd TEST PERIOD-LBS./CHARGE | | | | | | | | |
| Erie | 70,000 | | | | | | | |
| Sinter | 15,000 | | | | | | | |
| BOFS | 6,500 | 37.7 | 12.7 | 38.2 | 8.9 | 1.07 | 659 | 5 days |
| Dolomite | 4,000 | | | | | | | |
| Olivine | 1,500 | | | | | | | |
| Coke | 28,000 | | | | | | | |
| 3rd TEST PERIOD-LBS./CHARGE | | | | | | | | |
| Erie | 70,000 | | | | | | | |
| Sinter | 15,000 | | | | | | | |
| BOFS | 7,000 | 38.1 | 11.8 | 39.0 | 9.03 | 1.04 | 651 | 5 days |
| Dolomite | 3,000 | | | | | | | |
| Olivine | 1,500 | | | | | | | |
| Coke | 28,000 | | | | | | | |
| 4th TEST PERIOD-LBS./CHARGE | | | | | | | | |
| Erie | 70,000 | | | | | | | |
| Sinter | 15,000 | | | | | | | |
| BOFS | 7,000 | 36.7 | 12.8 | 39.1 | 8.8 | 1.03 | 668 | 5 days |
| Dolomite | 3,000 | | | | | | | |
| Olivine | 2,000 | | | | | | | |
| Coke | 28,000 | | | | | | | |
| 5th TEST PERIOD-LBS./CHARGE | | | | | | | | |
| Erie | 70,000 | | | | | | | |
| Sinter | 15,000 | | | | | | | |
| BOFS | 8,000 | 37.3 | 11.79 | 39.5 | 8.84 | 1.02 | 672 | 5 days |
| Dolomite | 2,000 | | | | | | | |
| Olivine | 2,000 | | | | | | | |
| Coke | 28,000 | | | | | | | |

In the above Table II the term:
ERIE means Iron Ore Pellets
Sinter means Sinter Clinker
BOFS means Basic Oxygen Furnace Slag Table II describes another series of tests of blast furnace operation in which the ingredients charged in one charge are given for a base period in which no olivine is included, and then during subsequent periods in which the olivine is first included at 1,000 lbs./charge and in subsequent periods increased up to 2,000 lbs./charge.

As shown by the chemical calculations given in Table II in the slag volume may increase with increased amounts of olivine, and the base/acid ratio decreases. An increase of the alkali metal component in the slag may be expected, and a noticeable improvement in the operation of the furnace.

It is an added feature of our invention and a further improvement that instead of charging a self contained volume of olivine into the furnace we may prepare an agglomerate which contains iron oxide containing materials mixed with olivine or which contains coke mixed with olivine, said agglomerate containing such mixtures in a solid, discrete form, and charging agglomerates into the furnace. As used in this specification and claims, the term "agglomerate" refers to a feed material which has been prepared by mixing particles of relatively small size and forming the mixture into discrete particles of relatively large size. The agglomerates may take the form of a ball, a lump, of pillow shape or any other such shape into which the mixture may be formed.

The primary purpose of using iron bearing materials in the form of agglomerates is to improve burden permeability so as to permit a higher rate of gas flow and better gas-solid contact within the furnace. The principal types of ore bearing agglomerates which have been used in the past are sinters, pellets, nodules, and briquettes.

The making of sinters has commonly involved the mixing of finely divided iron ores along with a small percentage of fuel such as coke and depositing the mixture on a moving grate. The mixture is ignited at the feed end of the grate and air is pulled down through the mixture. The temperature rises to about 2400° to 2700° F. and the final ore particles fuse together in porous coherent lumps called sinters. In our improved sintering operation we mix with the finely divided iron ores to be discharged onto the sintering grate a quantity of olivine ore in a finely divided state. The quantity may be from about 0.1 to 10.0 weight percent based on the total weight of the materials placed on the grate and subjected to the sintering operation. We prefer to use about 0.50 to 5.0 percent of olivine based on the total weight of the material mixture. The olivine when mixed into the sinter feed material should preferably be ground to a fine particle size which will pass a 4 mesh size screen. In this way we produce an improved sinter containing from about 0.5 to 5.0 weight percent of olivine which is continuously dispersed throughout the internal area of the formed sinter. The hot sinter may be cooled, sized, suitably to about ½ to 3" and fed along with other materials into a blast furnace.

One of the best agglomerates containing iron ore is known as pellets. Since much of the raw ore made into pellets is of relatively low iron content, the raw ore is usually concentrated to increase the iron content to something like 50.0 to 60.0 or greater weight percent before the pelletizing process begins. Concentration may be accomplished, for example, by magnetic separation, by washing, or by flotation separation. After concentration the ore usually has an iron content of above 50 weight percent.

In the pelletizing process the iron bearing ore or concentrate which may consist mainly of magnetite or hematite is ground to about minus 200 mesh and mixed with water and bentonite. It is then rolled into balls in a balling drum or disc. The balls may be approximately 0.25 to 1 inch in diameter. The "green pellets" so formed are then dried and heated to about 2200° F. to 2500° F. bonding the tiny grains together within each pellet. Because the heating step uses air for combustion the process is an oxidizing process and the heat generation is adequate to convert nearly all of the magnetite to hematite.

Bonding within the pellets is a crystalline bond which is due to the grain growth from the oxidation of magnetite to hematite. In the case of a hematite pellet, grain growth is due to recrystallization. In the case of both magnetite and hematite recrystallization of gangue silicates and aluminates (slag bonding) will promote more rapid strengthening at lower temperatures, and if the magnitude of slag bonding could be increased by any means the process energy requirements would be reduced.

In our improved pelletizing process there is mixed with the finely ground magnetite or hematite a quantity of olivine. Suitably the olivine to be so mixed is in a finely divided state, preferably in a form in which most of it will pass a 200 mesh screen. When the mixture containing the olivine has been balled and heated according to the steps above described, the pellets so formed may be cooled, sized suitably to from ⅜" to 1" and utilized along with other feed materials in charging a blast furnace.

The pellets so formed containing olivine are stronger by reason of their olivine content. Olivine's melting point is drastically decreased in the presence of iron oxide and its inclusion in the concentrate mix provides an excess of energy units to further recrystallization.

In addition, both the composition and structure of olivine are such that they duplicate the primary slag silicates, thus adding an amount of slag "pre-formation", which in turn will lower energy requirements in the furnace to which the improved pellets are fed.

Advantages of including olivine in the mix to be formed into pellets are:

1. The olivine produces an increase in the drop and compressive green ball strength of the agglomerate enabling a reduction in bentonite usage. In the blast furnace this effects a reduction in both alkali and alumina load in the furnace.

2. Olivine increases the fired strength of the pellets, resulting in pellets having increased resistance to degradation and lowered fines generation.

3. Olivine increases the amount of alkali metal oxides ($Na_2$) and ($K_2O$) removed in the furnace slag system and so minimizes swelling of the pellets by alkali reflux condensation. Aerodynamically this increases permeability of the blast furnace burden.

4. The eutectic temperature of olivine is high enough so that its stability is retained longer than any other mineral in the pellet mix. This results in increased gas-solid contact when the pellet is used in the operation of furnaces.

5. Introduction of olivine to an iron bearing pellet reduces the iron content and increases silica and magnesia content. The increase in magnesia is greater than in silica, resulting in an increase of basic oxides. This improves the self fluxing properties of the pellets. This may be demonstrated by a reference to the compositions of major magnetite pellets without olivine as compared to the expected compositions of pellets from the same sources with olivine included.

| | Fe | P | $SiO_2$ | Mn | $Al_2O_3$ | CaO | MgO | S |
|---|---|---|---|---|---|---|---|---|
| COMPOSITIONS OF SOME MAJOR MAGNETITE PELLETS (1968) | | | | | | | | |
| Minntac Pellets | 65.12 | 0.011 | 5.50 | 0.16 | 0.42 | 0.25 | 0.59 | 0.002 |
| Reserve Pellets | 62.56 | 0.028 | 8.76 | 0.27 | 0.47 | 0.44 | 0.51 | |
| Erie Pellets | 63.91 | 0.012 | 7.22 | 0.23 | 0.31 | — | — | |
| Eveleth Pellets | 65.39 | 0.023 | 5.50 | 0.14 | 0.29 | 0.19 | 0.30 | |
| EXPECTED COMPOSITIONS OF MAGNETITE PELLETS FROM THE SAME SOURCES CONTAINING ABOUT 1.0 PERCENT ADDED OLIVINE | | | | | | | | |
| Minntac Pellets | 64.46 | — | 5.90 | — | — | — | 1.04 | |
| Reserve Pellets | 61.90 | — | 9.16 | — | — | — | 0.96 | |
| Erie Pellets | 63.25 | — | 7.62 | — | — | — | +0.45 | |

-continued

| | Fe | P | $SiO_2$ | Mn | $Al_2O_3$ | CaO | MgO | S |
|---|---|---|---|---|---|---|---|---|
| Eveleth Pellets | 64.72 | — | 5.90 | — | — | — | 0.75 | |

The amount of olivine introduced into the mix in the manufacture of pellets, and also in the manufacture of other iron bearing agglomerates, may vary between 0.10 and 15.0 weight percent based on the weight of the agglomerates preferably between 0.25 and 5.00 weight percent, and may be ground to a size of about minus 200 mesh or as close as is practicable to the size of the iron concentrate. The olivine is mixed with the bentonite feed mix before the balling sequence. In the case of a specular hematite concentrate the olivine may be added at the mineral blending stage. Specular hematites are usually difficult to ball because of their plate-like structure, but the addition of olivine by reason of its stability and hardness is useful in abrading the platey structure to facilitate the balling operation.

Cyanide emission in the blast furnace is a normal by-product of its high temperature flame, and its potentiation has a direct correlation with the alkali load a furnace is carrying at any given time. Although the amounts of cyanide ionization cannot be diminished, the fixation of the cyanide radical with alkalis may be reduced through slag removal. Olivine bearing iron pellets accomplish this by reducing the availability of the alkali ions to react. This produces a more readily degradable and simpler cyanide compound, such as hydrocyanic acid, rather than a more complex alkali salt.

It will be understood that the basic steps involved in the production of pellets are in many respects utilized in the manufacture of other iron bearing agglomerates such as sintering, nodulizing and briquetting, and the advantages above set forth in connection with pellets containing olivine are in most respects applicable to the other agglomerates which contain olivine.

In the nodulizing process, fine iron bearing materials are introduced into a rotary kiln and formed into nodules or lumps. The nodules are heated as they are rolled. In our improved nodulizing process olivine in an amount of from 0.10 to 15.0 weight percent, preferably from 0.25 to 5.00 weight percent, based on the total weight of the nodule is mixed in and the mix introduced into the kiln. In the nodulizing process the feed moisture and particle size are not so important as in the pelletizing process.

In the briquetting process, finely divided iron bearing materials such as flue dust, certain coal or coke materials, etc., may be utilized, and in our improved process the iron bearing materials and olivine are mixed in the proportion of from about 0.10 to 15.0 weight percent of olivine, preferably from about 0.25 to 5.00 weight percent of olivine, based on the total weight of the material which goes to form the briquette, and the resulting iron-olivine mixture is passed into a press such as a roll press or punch press to form the briquettes. The briquettes may be heated or formed cold, but cold briquettes especially as previously produced have been found to be low in strength and not very useful because of this failing. Our improved briquettes containing olivine have greater strength and are deemed more useful in furnace operation for this reason.

In the preparation of our improved sinters or briquettes we may start with the materials heretofore used in making sinters such as ore fines, mill scale, blast furnace flue dust, limestone or dolomite. The olivine so obtained may be fired to produce the sinters. The sinters thus produced may then be used as an ingredient in the charging of the blast furnace.

The olivine may also be used in a similar way starting with similar materials to produce the improved briquettes, and either the sinters or the briquettes constitute agglomerates which may be charged into the furnace. To demonstrate the starting materials used in such preparation of agglomerates we set forth typical ingredients in proportions in the following Table III.

TABLE III

| Materials | Weight Percent |
|---|---|
| Ore Fines | 30 to 50 |
| Mill Scale | 10 to 25 |
| Blast Furnace Flue Dust | 5 to 15 |
| Coke Breeze | 1 to 5 |
| Limestone Fines | 1 to 10 |
| Dolomite Fines | 1 to 10 |
| Olivine Fines | 0.10 to 15.0 |

The improved agglomerates above described whether prepared by sintering, pelletizing, nodulizing or briquetting, normally will contain iron principally in the form of $Fe_2O_3$, but still further improvement may be had by concentrations by pre-reducing the iron oxides and in this way making the agglomerates more desirable as a charge in blast furnaces. After the iron ore and the olivine have been ground to the desired fineness and mixed as we have explained in the foregoing description for making the agglomerates, the mixture may be treated by any of the processes heretofore utilized for pre-reducing the iron content. Such processes may involve the heating of the iron ore-olivine mixture in the presence of a carbonaceous reducing agent with an excess of air, suitably in a rotary kiln. Alternately, the iron ore-olivine mixture may be heated in a retort to produce sponge iron. Chemically, the iron in the form of $Fe_2O_3$ is converted to $Fe_3O_4$ and $Fe_3O_4$ is converted to FeO. Pre-reduction of the iron ore may be conducted to the desired extent to partially pre-reduce the ore, and following the pre-reduction treatment brought to the form of sinters, pellets, nodules or briquettes using technology above set forth.

In the above description we have referred to agglomerates which essentially contain a quantity of iron bearing ore. Another type of agglomerate is that containing essentially a fuel such as coke, and olivine. To prepare this type of agglomerate, the coke, or other such fuel, is ground into fine particles and mixed with olivine also in fine particles in a proportion, for example of about 0.10 to 15.0, preferably from about 0.25 to 5.00 weight percent of olivine based on the total weight of the mixture, with the addition of an amount of water necessary to a briquetting procedure, and a mixture thus prepared may be pressed to make briquettes which may be pillow shaped or of any other desired shape and suitably may be of a size such as 1" to 3" square. Alternately, the coke-olivine mixture may be nodulized or otherwise treated to bring it into agglomerate form.

The coke-olivine agglomerations may be fed along with iron bearing ingredients into a blast furnace. They have a special advantage in such operations. We have already discussed the action of olivine in overcoming the effect of the alkali metal oxides resulting in the elimination or minimizing the scaffolding effect which is so detrimental to the operation. A substantial quantity of such alkali metal oxides come into the furnace by way of the coke feed and this quantity has been increasing in recent years as the quality of the coke being used decreases. From about 20 to 80 percent of these alkalis may be contained in the coke feed. By incorporating the olivine as a mixture in the coke agglomerates the olivine is thus brought into proximity with the highest concentration of alkali metal oxides and so functions to better advantage in overcoming the effect of these alkalis.

We believe that one important reason for the improvement when using olivine in the form of mixtures containing agglomerates is that the agglomerates are structurally stronger and better resist degradation in the course of the iron making process. Their improved strength may be demonstrated both by dropping the agglomerates or by compressing them until they begin to break up. Another reason which we believe to be important in explaining the improved results obtained in using our agglomerates is that it is easier to distribute the olivine across the furnace and better distribution of the olivine can be brought about. This makes for more uniform reactions and the minimizing of spots in the furnace where scaffolding may occur.

While we have described our invention with respect to certain modes and embodiments it will be apparent to those skilled in this art that the invention may be embodied in many forms and many changes may be made all within the spirit of the invention and the scope of the appended claims.

We claim:

1. An improved iron oxide-containing pellet, said pellet produced by mixing finely divided iron oxide-containing material with finely divided olivine, said iron oxide-containing material having an iron content of above 50 weight percent and containing silica gangue; forming said iron oxide and olivine mixture into green pellets; and heating said green pellets to about 2200° to 2500° F. so as to bond said iron oxide and olivine mixture together in said pellet, said olivine being introduced into said mixture in an amount between 0.1 and 15.0 weight percent based on the weight of said pellet.

2. The pellet of claim 1 wherein said olivine is introduced into said mixture in an amount between 0.25 and 5.0 weight percent based on the weight of said pellet.

3. The pellet of claim 2 wherein said finely divided iron oxide containing material has a particle size of minus 200 mesh.

4. The pellet of claim 3 wherein said finely divided olivine has a particle size of minus 200 mesh.

5. The pellet of claim 2 wherein said mixture is formed into balls of approximately 0.25 to 1.0 inch in diameter.

6. The pellet of claim 2 wherein said heating step is an oxidizing process.

* * * * *

UNITED STATES PATENT AND TRADEMARK OFFICE

CERTIFICATE OF CORRECTION

PATENT NO. : 4,963,185

DATED : October 16, 1990

INVENTOR(S) : Frank H. Ellenbaum et al.

It is certified that error appears in the above-identified patent and that said Letters Patent is hereby corrected as shown below:

Column 2, line 68, "produce" should be -- produced --

Column 5, line 66, delete "in"

Claim 1, line 1, after "pellet" insert -- suitable for feeding to a blast furnace in which said iron oxide is reduced to produce molten iron --

Signed and Sealed this

Fifth Day of May, 1992

*Attest:*

*Attesting Officer*

DOUGLAS B. COMER

*Acting Commissioner of Patents and Trademarks*